US005476140A

United States Patent [19]

Lu

[11] Patent Number: 5,476,140

[45] Date of Patent: Dec. 19, 1995

[54] ALTERNATELY STAGGERED LOUVERED HEAT EXCHANGER FIN

[75] Inventor: James W. B. Lu, Mt. Pleasant, S.C.

[73] Assignee: Behr Heat Transfer Systems, Inc., Charleston, S.C.

[21] Appl. No.: 391,929

[22] Filed: Feb. 21, 1995

[51] Int. Cl.[6] ..... F28D 1/04; F28F 1/20

[52] U.S. Cl. ..... 165/152; 165/183; 29/890.046

[58] Field of Search ..... 165/152, 183; 29/890.046

[56] References Cited

U.S. PATENT DOCUMENTS

| | | | |
|---|---|---|---|
| 1,906,077 | 4/1933 | Modine | 165/152 |
| 3,262,495 | 7/1966 | Baird | 165/152 |
| 3,298,432 | 1/1967 | Przyborowski . | |
| 3,998,600 | 12/1976 | Wallis | 165/152 X |
| 4,420,039 | 12/1983 | Dubrovsky . | |
| 4,966,230 | 10/1990 | Hughes et al. . | |
| 5,289,874 | 3/1994 | Kadle et al. . | |
| 5,390,731 | 2/1995 | Selm et al. | 165/152 |

*Primary Examiner*—Allen J. Flanigan
*Attorney, Agent, or Firm*—Howard & Howard

[57] ABSTRACT

A heat exchanger (10) includes a pair of manifolds (12, 14) interconnected by a core member having a plurality of fluid tubes (20) extending between manifolds (12, 14) and fins (22) connected between adjacent fluid tubes (20). The fin (22) is comprised of a corrugated sheet of material forming peaks connected to the tubes (20) with fin walls (34) extending between peaks. Alternating walls (34) of the fin (22) are comprised of an uninterrupted section (40) and a louvered section (42). The uninterrupted section (40) is defined by either a sinusoidal wave of continuous sheet or straight section deformed into the wall (34). The louvered section (42) is defined by a plurality of louvers (46) interrupting and cut into the sheet formed in the wall (34) providing air gaps.

6 Claims, 2 Drawing Sheets

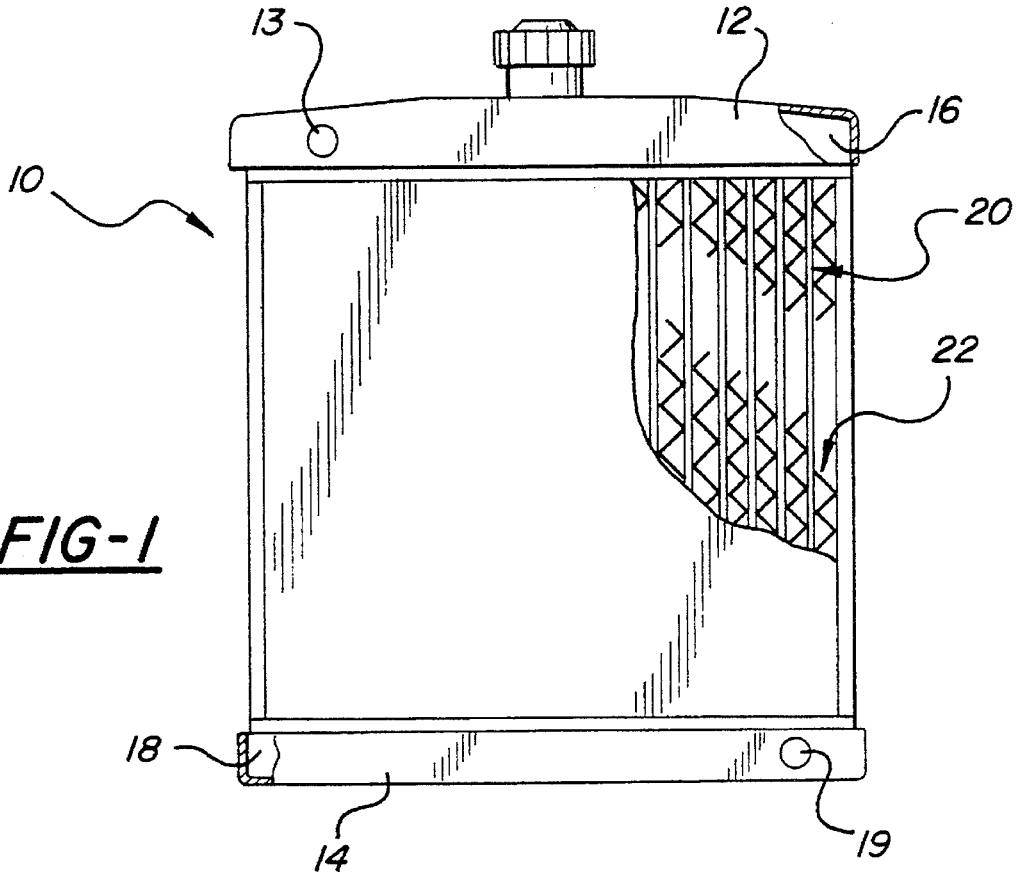
FIG-1
FIG-2
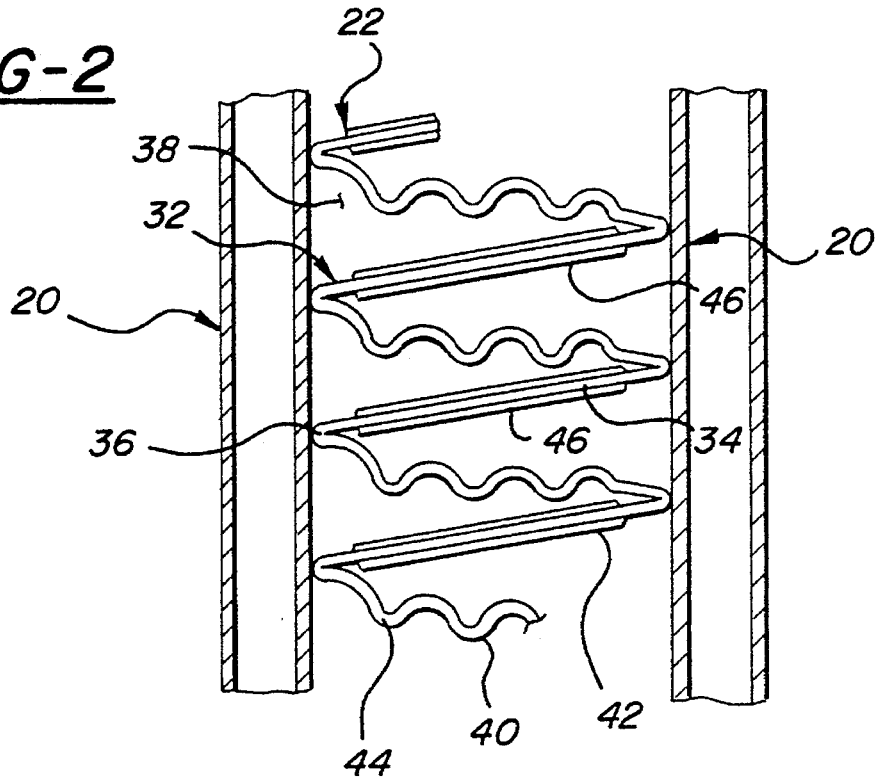

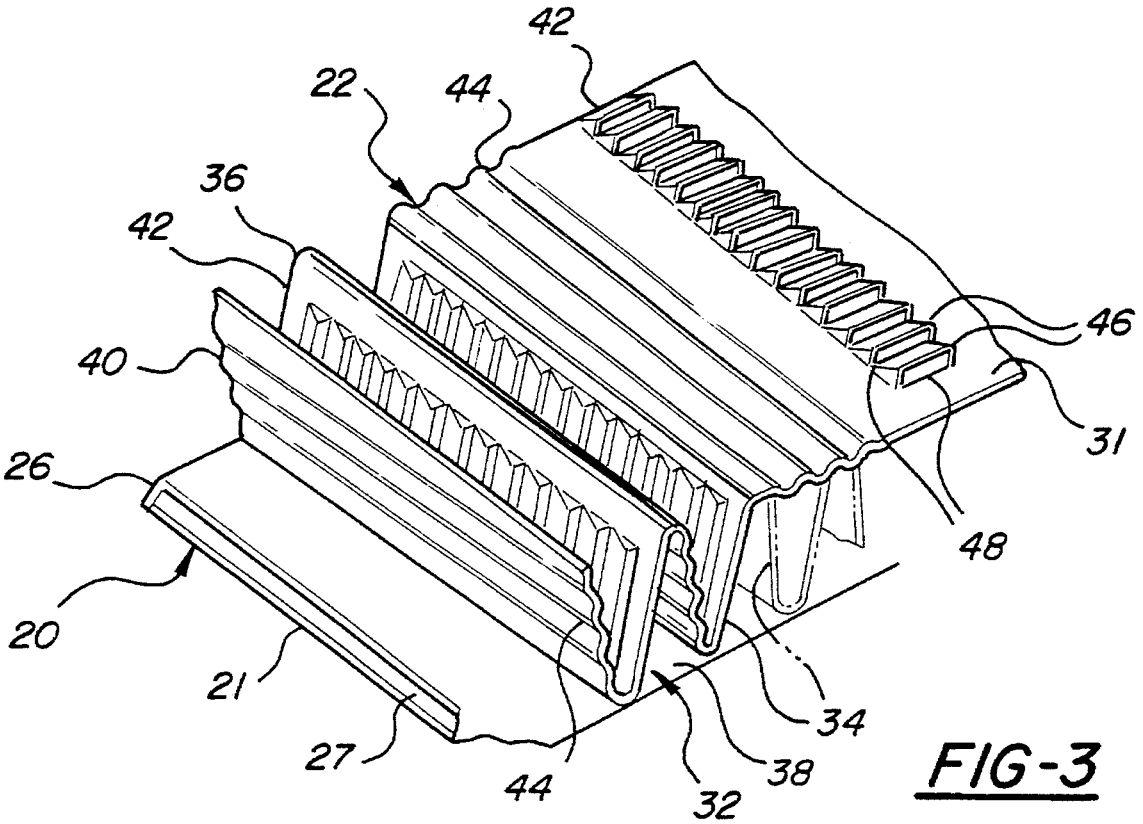
FIG-3
FIG-4
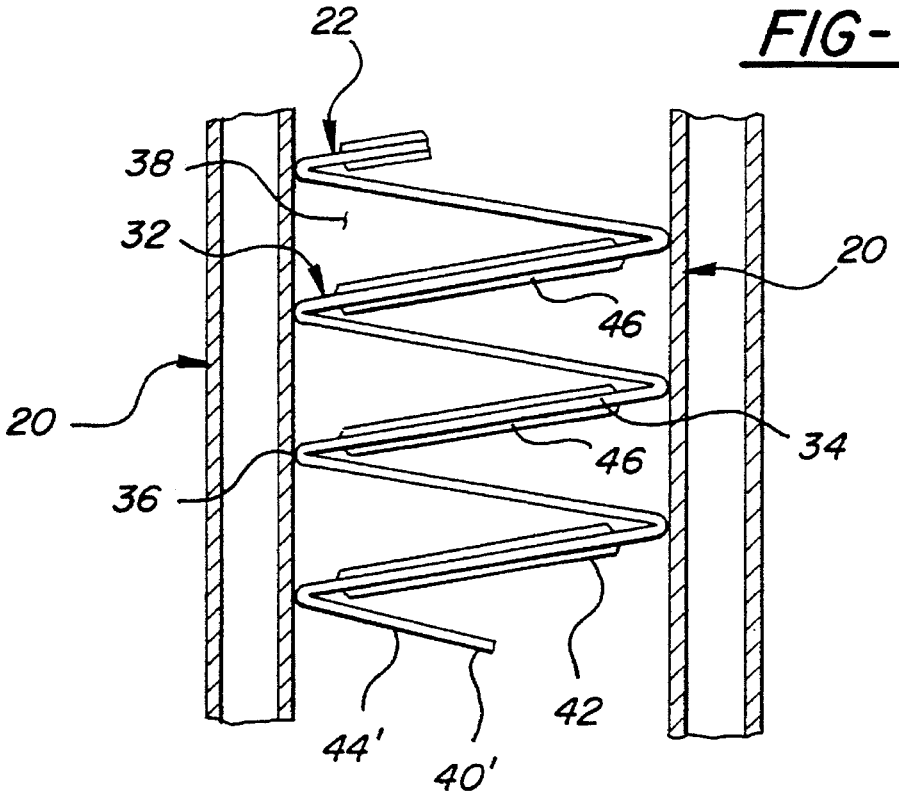

ALTERNATELY STAGGERED LOUVERED HEAT EXCHANGER FIN

TECHNICAL FIELD

The subject invention relates to heat exchangers of the type including two tanks in fluid communication through a plurality of fluid tubes extending therebetween, and fins connected therebetween the fluid tubes to allow heat exchange with ambient air passing externally thereover. More specifically, the invention is directed toward the configuration of the fins.

BACKGROUND OF THE INVENTION

Commonly known in the art are heat exchangers used in connection with an automotive vehicle for cooling the engine thereof. The heat exchanger generally comprises an upper and lower manifold for providing fluid reservoirs and a plurality of cooling tubes extending between the manifolds to provide fluid communication therebetween. Coolant passes through the upper and lower manifolds. These types of heat exchangers are liquid to air because liquid passes through the tanks and tubes while air is passed externally in between the tubes for cooling the fluid therein. There are also air to air heat exchangers wherein air is passed within the tubes and air is passed externally thereover for heat exchange.

Heat exchangers also include fin structures disposed between coolant tubes for directing ambient air about the coolant tubes. Such fins enhance heat exchanger performance and are common in the art as shown in U.S. Pat. No. 4,821,795 to Lu, assigned to the assignee of the subject invention.

It has been important to maximize heat transfer between the fin and the fluid tube by turbulating the passing air over the fins to maximize the amount of cold air contacting the surface area of the fins. Also, a concern is to minimize the pressure drop in air passing through the exchanger. One type of heat exchanger utilizing various configurations of fins is disclosed in U.S. Pat. No. 3,298,432, issued Jan. 17, 1967 in the name of Prezyborowski. This patent discloses a heat exchanger including a plurality of spaced fluid tubes with fins disposed in a corrugated manner therebetween. As best shown in FIG. 7, the fins include a plurality of sinusoidal wall sections at the ends thereof. In addition, several wall sections along a middle portion of each fin include louvers thereon. The sinusoidal wall sections may also be included within the center of the length of fins.

A problem with these types of prior systems is the significant pressure drop across the louvered fins.

SUMMARY OF THE INVENTION

The invention includes a heat exchanger assembly for exchanging heat with a cooling fluid. The assembly comprises first and second manifolds and a plurality of fluid tubes connected between the first and second manifolds for communicating fluid therebetween wherein the tubes include tube walls having a tube width. Also included is fin means conductively connected between adjacent of the tube walls. The assembly is characterized by the fin means comprising a plurality of undulations establishing lengths of walls connected between the tube walls forming air channels extending the width of the tube walls. Every other of the walls include a uninterrupted section and the remaining walls include a louvered section adjacent the air channels.

The uninterrupted section is formed with a smooth surface pattern adjacent the air channels, and the louvered section includes louvers cut into the wall and deformed along the air channels.

Also included is a method for making the fin of the heat exchanger assembly described above.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a partially cut away plan view of the heat exchanger assembly;

FIG. 2 is an enlarged cross sectional view of the fluid tubes with fins;

FIG. 3 is a perspective view showing a portion of a partially formed fin of the assembly; and FIG. 4 is an enlarged cross sectional view similar to FIG. 2 illustrating a second embodiment.

DETAILED DESCRIPTION OF THE INVENTION

A heat exchanger of the type commonly used in conjunction with an automotive vehicle is generally illustrated at 10 in FIG. 1. The heat exchanger 10 comprises an upper 12 and lower 14 manifold providing upper 16 and lower 18 fluid reservoirs or tanks, respectively. A plurality of fluid tubes 20 extend between the tanks 16, 18 for communicating either a liquid or gas throughout the heat exchanger assembly 10. A plurality of external fins 22 extend between the fluid tubes 20 in either air-to-air or liquid-to-air exchangers. The manifolds 12, 14 and tubes 20 are commonly known in the art, and may be of commonly known configurations.

In general, as a heated fluid passes through the fluid tubes 20 (supplied through an inlet 13), heat is absorbed therefrom by a cooling fluid, preferably ambient air, flowing about the exterior of the fluid tubes 20. The cooling fluid exits from the assembly 10 at a high temperature due to the exchange of heat with the fluid tubes 20. The heated fluid within the tubes 20 is thus cooled to a lower temperature and exits the assembly 10 by way of an outlet 19 in the tank 18.

The fins 22 are positioned between adjacent fluid tubes 20 for directing the cooling fluid about the outer portions of the fluid tubes 20. The fluid tubes 20 have opposing flat, elongated sides 21 as shown in FIG. 3. The flat sides 21 of the tubes 20 enhance heat exchange due to the large surface area of the tubes 20 exposed to cooling fluid flowing externally about the tubes 20. Furthermore, the flat sides 21 allow the fluid tubes 20 to be stacked more closely together than, for instance, circular shaped tubes. The fluid tubes 20 are comprised of tube walls 26 forming the fluid passage 27 therein. It should be understood that fins 22 described herein may alternatively be utilized internal the fluid tubes 20 to enhance heat transfer of the whole tube 20 with less pressure drop. Placement of fins in tubes are commonly known in the art.

The fins 22 are utilized to increase the exchange of heat with air flowing across the fin 22. The fins 22 are positioned between the tube walls 26 of adjacent spaced fluid tubes 20 to allow air to flow thereacross from the air inlet side (front face) of an heat exchanger 10 to the air outlet side (rear face) as illustrated in FIG. 1.

The fins 22 are formed from a thin metallic or heat conductive sheet 31 of material formed in a plurality of undulations 32 which establish straight length of walls 34 which extend between tube walls 26, with the peaks 36 of the undulations 32, conductively connected to and contacting the flat sides 21 of the tube walls 26. The peaks 36 are generally brazed or soldered to the sides 21 of the walls 26. The undulations 32 form air channels 38 extending along the length of walls 34 of the undulations 32.

The lengths of walls 34 include a series of alternating pairs of a smooth, uninterrupted, continuous wall section 40 and slotted or interrupted, louvered wall section 42. The smooth wall section 40 is formed with non-linear, wave formation 44 and the slotted louvered wall section 42 includes louvers 46 formed by a slit opening in the wall 34 forming a panel bent outwardly from or angled with respect to the wall 34. The sections 40, 42 are formed longitudinally along the channels 38 and spaced from the peaks 36. The sections 40, 42 are created by deforming the sheet 31 along each wall 34.

More specifically, the smooth wall section 40 comprises as the wave formations 44 a sinusoidal wave pattern extending longitudinally along the length of the channels 38, traverse between the peaks 36. Such sinusoidal wave pattern may be a uniform wave pattern or may comprise nonlinear contours of different heights, widths or shapes. It is to be understood that alternatively, the wall section 40' may be comprised of a straight, smooth formations 44', i.e., as originally formed without waves formed therein. (See FIG. 4).

The panels 46 of the interrupted or slotted louvered wall section 42 are generally formed by a plurality of straight slit 48 cut in a row into the sheet 31 and extending between and spaced from the peaks 36 causing discontinuity in said wall 34. The panels formed between adjacent slits 48 from the louvers 46 by being bent on an angle with respect to the sheet 31 between slits 48 and extending into the air channel 38 providing gap or interruption in the wall 34 to allow air to flow therethrough. The louvered wall section 42 comprises a plurality of side by side louvers 46 so formed. Such louvered configuration is commonly known in the art, and may include longitudinal sections of opposingly angled louvers 46, 46'. Any combination of louvers 46 would be suitable.

As illustrated in FIGS. 2 and 3, each alternating wall 34 comprises pairs of the smooth wall section 40 and the louvered wall section 42. In other words, every other wall 34 comprises the smooth wall section 40 with the other walls 34 comprising the louvered wall section 42, as is illustrated. The sections 40, 42 extend the length of the channels 38 for each respective wall 34.

This configuration of alternating louvered and smooth wall sections 40, 42 allow for an increase in surface area of the fin 22 exchanging heat with the air passing therethrough while minimizing the turbulence of the air to maintain a minimum air pressure drop passing therethrough. The louvered fin or section 42 acts as a turbulator for the adjacent smooth surfaced fin or section 40, 40' to enhance both the louvered section 42 and adjacent smooth section 40, 40' in heat transfer with lower pressure drop.

Also included is a method of making the fins 22 for the heat exchanger assembly 10. The method includes the step of providing a flat sheet 31 of heat conducting material (see the right side of FIG. 3). Alternating transverse rows of spaced slits 48 and waves 44 (optionally leave 44' straight) are formed across the sheet 31. The panels between the slits 48 are angled with respect to the sheet 31 to form the louvers 46. The sheet 31 is then deformed into the undulations 32 having peaks 36 with walls 34 extending between the adjacent peaks 36, with the alternating rows of louvers 46 and waves 44 (or straight 44') forming the alternating walls 34 in the corrugations 32. The fin 22 is then formed, and may be assembled with the fluid tubes 20, and manifolds 12, 14 as commonly known in the art.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A heat exchanger assembly for exchanging heat with a cooling fluid, said assembly comprising:

first and second manifolds (12, 14);

a plurality of fluid tubes (20) connected between said first and second manifolds (12, 14) for communicating fluid therebetween, said tubes (20) including tube walls (26) and a tube width;

fin means (22) conductively connected between adjacent of said tube walls (26);

said assembly characterized by said fin means (22) comprising a plurality of undulations (32) establishing lengths of walls (34) connected between said tube walls (26) and forming air channels (38) extending the width of said tube walls, every other of said walls (34) including a smooth uninterrupted section (40, 40') and the remaining walls (34) including a louvered section (42) which extend along said air channels (38), said uninterrupted section (40, 40') formed with an undulating surface pattern adjacent said air channels (38) and said louvered section (42) including louvers (46) cut into said wall (34) causing interruptions in said wall (34) and deformed along said air channels (38).

2. An assembly as set forth in claim 1 wherein all of said walls (34) between said first and second tanks (12, 14) are comprised of either said uninterrupted section (40) or said louvered section (42) extending for said lengths of walls (34).

3. An assembly as set forth in claim 2 further characterized by said louvers (46) comprising a plurality of slits (48) formed in said wall (34) transverse to said air channel (38) forming panels between adjacent slits, said panels bent angular with respect to said wall (34) and including a portion extending into said air channels (38) forming air gaps in said wall (34) to draw air therethrough.

4. An assembly as set forth in claim 3 further characterized by said uninterrupted section (40) comprising a uniform sinusoidal wave pattern extending along said air channel (38) and formed in said wall (34) spaced from said fluid tubes (20).

5. An assembly as set forth in claim 4 further characterized by said uninterrupted section (40) formed by a uniform sinusoidal wave pattern extending the length of said wall (34) along said air channels (38).

6. A method of making fins (22) for a heat exchanger assembly which includes a plurality of fluid tubes (20) extending between a pair of manifolds tanks (12, 14), the method including the steps of:

providing a flat sheet (31) of heat conducting material;

forming alternating transverse rows of spaced louvers (46) and with rows of waves along the sheet; and deforming the sheet (31) into undulations (32) having peaks (36) between the rows and walls (34) extending between adjacent peaks (36) having formed therein the rows of spaced louvers (46) interrupting the wall and alternating with the rows of waves (44).

* * * * *